US007158736B2

(12) United States Patent
Sato et al.

(10) Patent No.: US 7,158,736 B2
(45) Date of Patent: Jan. 2, 2007

(54) PROCESS CARTRIDGE HAVING FIRST AND SECOND ROTATABLY COUPLED FRAMES AND ELECTROPHOTOGRAPHIC IMAGE FORMING APPARATUS MOUNTING SUCH PROCESS CARTRIDGE

(75) Inventors: Masaaki Sato, Shizuoka-ken (JP); Atsushi Numagami, Hadano (JP); Shigeo Miyabe, Numazu (JP); Shinjiro Toba, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 137 days.

(21) Appl. No.: 10/960,077

(22) Filed: Oct. 8, 2004

(65) Prior Publication Data

US 2006/0072938 A1 Apr. 6, 2006

(30) Foreign Application Priority Data

Oct. 6, 2004 (JP) ..... 2004/293847

(51) Int. Cl.
*G03G 15/08* (2006.01)

(52) U.S. Cl. ..... 399/111

(58) Field of Classification Search ..... None
See application file for complete search history.

(56) References Cited

U.S. PATENT DOCUMENTS

| | | | | |
|---|---|---|---|---|
| 5,463,446 | A | 10/1995 | Watanabe et al. | 355/200 |
| 5,500,714 | A | 3/1996 | Yashiro et al. | 355/200 |
| 5,543,898 | A | 8/1996 | Shishido et al. | 355/210 |
| 5,585,889 | A | 12/1996 | Shishido et al. | 355/200 |
| 5,585,895 | A | 12/1996 | Yashiro et al. | 355/215 |
| 5,617,579 | A | 4/1997 | Yashiro et al. | 399/114 |
| 5,689,774 | A | 11/1997 | Shishido et al. | 399/111 |
| 5,839,028 | A | 11/1998 | Nomura et al. | 399/109 |
| 5,870,654 | A | 2/1999 | Sato et al. | 399/109 |
| 5,873,012 | A | 2/1999 | Miyabe et al. | 399/90 |
| 5,878,309 | A | 3/1999 | Nomura et al. | 399/111 |
| 5,878,310 | A | 3/1999 | Noda et al. | 399/117 |
| 5,920,753 | A | 7/1999 | Sasaki et al. | 399/111 |
| 5,926,666 | A | 7/1999 | Miura et al. | 399/25 |
| 5,937,239 | A | 8/1999 | Watanabe et al. | 399/111 |
| 5,937,242 | A | 8/1999 | Yokoyama et al. | 399/114 |
| 5,943,529 | A | 8/1999 | Miyabe et al. | 399/111 |
| 5,946,531 | A | 8/1999 | Miura et al. | 399/111 |
| 5,950,047 | A | 9/1999 | Miyabe et al. | 399/111 |
| 5,966,566 | A | 10/1999 | Odagawa et al. | 399/109 |
| 5,966,567 | A | 10/1999 | Matsuzaki et al. | 399/111 |

(Continued)

FOREIGN PATENT DOCUMENTS

JP 55-15177 2/1980

*Primary Examiner*—Quana Grainger
(74) *Attorney, Agent, or Firm*—Fitzpatrick, Cella, Harper & Scinto

(57) ABSTRACT

A cartridge detachably mountable to an apparatus includes a drum, a developing roller, first and second frames supporting the drum and roller, a coupling member rotatably connecting the frames, a first cartridge positioning portion abuttable to a first main assembly positioning portion positioning the cartridge with respect to a direction crossing the drum axis when the cartridge is mounted to the apparatus, a drive input gear engaging a main assembly driving gear, and a second cartridge positioning portion abuttable to a second main assembly positioning portion limiting cartridge rotation about the first cartridge positioning portion. When the cartridge is in the apparatus, the coupling member crosses a phantom line perpendicular to the second main assembly positioning portion and which passes through the second positioning portion, as seen from one end with respect to the axis.

8 Claims, 15 Drawing Sheets

U.S. PATENT DOCUMENTS 5,966,568 A 10/1999 Numagami et al. ..... 399/111
6,006,058 A 12/1999 Watanabe et al. ..... 399/167
6,016,413 A 1/2000 Yokoyama et al. ..... 399/113
6,029,031 A 2/2000 Yokomori et al. ..... 399/109
6,029,032 A 2/2000 Watanabe et al. ..... 399/111
6,064,843 A 5/2000 Isobe et al. ..... 399/111
6,097,908 A 8/2000 Uchiyama et al. ..... 399/111
6,097,909 A 8/2000 Watanabe et al. ..... 399/111
6,101,354 A 8/2000 Nakagawa et al. ..... 399/225
6,154,623 A 11/2000 Suzuki et al. ..... 399/111
6,169,866 B1 1/2001 Watanabe et al. ..... 399/111
6,173,140 B1 1/2001 Suzuki et al. ..... 399/113
6,185,390 B1 2/2001 Higeta et al. ..... 399/90
6,188,856 B1 2/2001 Sato ..... 399/119
6,236,821 B1 5/2001 Yokoyama et al. ..... 399/113
6,246,849 B1 6/2001 Yokoyama et al. ..... 399/117
6,266,500 B1 7/2001 Numagami et al. ..... 399/104
6,272,299 B1 8/2001 Numagami et al. ..... 399/111
6,289,189 B1 9/2001 Numagami et al. ..... 399/111
6,311,026 B1 * 10/2001 Higeta et al. ..... 399/13
6,317,572 B1 11/2001 Miyabe et al. ..... 399/111
6,351,620 B1 2/2002 Miyabe et al. ..... 399/111
6,415,121 B1 7/2002 Suzuki et al. ..... 399/111
6,463,233 B1 10/2002 Kojima et al. ..... 399/111
6,519,431 B1 2/2003 Toba et al. ..... 399/111
6,542,706 B1 4/2003 Toba et al. ..... 399/111
6,549,736 B1 4/2003 Miyabe et al. ..... 399/111
6,577,831 B1 6/2003 Kojima et al. ..... 399/111
6,603,939 B1 8/2003 Toba et al. ..... 399/103
6,608,980 B1 8/2003 Murayama et al. ..... 399/111
6,678,488 B1 1/2004 Toba et al. ..... 399/111
6,714,752 B1 3/2004 Ueno et al. ..... 399/117
6,795,666 B1 9/2004 Miyabe et al. ..... 399/109
6,829,455 B1 12/2004 Yasumoto et al. ..... 399/167
6,836,629 B1 12/2004 Miyabe et al. ..... 399/111
2002/0085854 A1 7/2002 Numagami et al. ..... 399/90
2002/0159787 A1 10/2002 Chadani et al. ..... 399/109
2002/0191981 A1 12/2002 Miyabe et al. ..... 399/90
2003/0235429 A1 12/2003 Sato et al. ..... 399/111
2004/0037590 A1 2/2004 Morioka et al. ..... 399/167

* cited by examiner (a)

(b)

(a)

(b)

(a)

(b)

PROCESS CARTRIDGE HAVING FIRST AND SECOND ROTATABLY COUPLED FRAMES AND ELECTROPHOTOGRAPHIC IMAGE FORMING APPARATUS MOUNTING SUCH PROCESS CARTRIDGE

FIELD OF THE INVENTION AND RELATED ART

The present invention relates to a process cartridge and electrophotographic image forming apparatus usable therewith.

The electrophotographic image forming apparatus forms an image on a recording material through an electrophotographic image formation type process. The electrophotographic image forming apparatus may be an electrophotographic copying machine, an electrophotographic printer (a LED printer, a laser beam printer or the like), an electrophotographic printer type facsimile machine, an electrophotographic printer type word processor or the like.

In the field of an electrophotographic image forming apparatus using an electrophotographic image process, a process cartridge type is known in which an electrophotographic photosensitive member i.e., an electrophotographic photosensitive drum and process means actable on the electrophotographic photosensitive drum are integrally contained in a cartridge which is detachably mountable to a main assembly of an electrophotographic image forming apparatus as a unit. Such is process cartridge type is advantageous in that a maintenance operation of the apparatus can be performed by the user without relying on a serviceman, and therefore, the operability is good. Therefore, the process cartridge type is widely used in the field of image forming apparatus.

The electrophotographic image forming apparatus may be an electrophotographic copying machine, an electrophotographic printer (a LED printer, a laser beam printer or the like), an electrophotographic printer type facsimile machine, an electrophotographic printer type word processor or the like. This forms an electrostatic latent image on the photosensitive drum. The electrostatic latent image thus produced is developed by a developing member which is build in the process cartridge. The developed image formed on the photosensitive drum is transferred onto the recording material. In this manner, an image is formed on a recording material.

In a conventional example, a developing device 1 includes a developing roller 3 swingably supported on a supporting shaft 8 provided in the main assembly of the image forming apparatus, and a follow gear 6 for transmitting the driving force to the developing roller 3 (Japanese Laid-open Patent Application Sho 55-15177). The follow gear 6 is rotatably supported on an outside of a side plate supporting the developing roller 3, and it is brought into meshing engagement with a driving gear 7 provided in the main assembly of the image forming apparatus to transmit the driving force. The developing device 1 is correctly positioned relative to the main assembly of the image forming apparatus by the side plate abutting a stopper 9 provided in the main assembly of the image forming apparatus. With this arrangement, the position where the driving force is transmitted to the follow gear 6 and the position where the side plate is abutted to the stopper 9 are different in the longitudinal direction of the developing device 1. Therefore, when the driving force is transmitted from the driving gear 7, the developing device 1 is subjected to a moment about the position where the side plate is abutted to the stopper 9 with respect to the longitudinal direction of the developing device 1. With this structure shown in FIG. 3, a moment is produced about a position where the side plate is abutted to the stopper 9 with respect to the widthwise direction of the developing device 1. Therefore, there is a possibility that the produced moment may adversely affect the positional accuracy of the developing roller 3 or the like.

SUMMARY OF THE INVENTION

Accordingly, it is a principal object of the present invention to provide a developing cartridge, a process cartridge and an electrophotographic image forming apparatus, in which the developing cartridge or the process cartridge are subjected to less bending moment and less deformation thereof when the developing cartridge or the process cartridge, set in place in the main assembly of the electrophotographic image forming apparatus, receives the driving force from the main assembly of the apparatus.

It is another object of the present invention to provide a process cartridge and an electrophotographic image forming apparatus in which the process cartridge includes a first frame and a frame rotatably connected with the frame, wherein the first frame is subjected to less bending moment and less deformation thereof when the process cartridge, set in place in the main assembly of the electrophotographic image forming apparatus, receives the driving force from the main assembly of the apparatus.

It is a further object of the present invention to provide a developing cartridge, a process cartridge and an electrophotographic image forming apparatus in which even when the rotational driving force is transmitted from the main assembly of the electrophotographic image forming apparatus, the developing roller is kept positioned with high accuracy relative to the main assembly of the apparatus.

It is a further object of the present invention to provide a downsized process cartridge and a downsized electrophotographic image forming apparatus.

According to an aspect of the present invention, there is provided a process cartridge detachably mountable to an electrophotographic image forming apparatus, the process cartridge comprising an electrophotographic photosensitive drum; a developing roller for developing an electrostatic latent image formed on an electrophotographic photosensitive drum; a first frame supporting the electrophotographic photosensitive drum; a second frame supporting the developing roller; a coupling member for rotatably coupling the first frame and the second frame; a first cartridge positioning portion which is provided at each of one and the other longitudinal end portions of the process cartridge and which is abuttable to a first main assembly positioning portion provided in the main assembly of the apparatus to position the process cartridge with respect to a direction crossing a direction of an axis of the electrophotographic photosensitive drum, when the process cartridge is mounted to the main assembly of the apparatus; a drive input gear, provided at the one of the longitudinal end portions, for engagement with a main assembly driving gear provided in the main assembly to receive a rotational driving force for rotating the developing roller; a second cartridge positioning portion which is provided at one longitudinal end portion of the process cartridge and which is abuttable to a second main assembly positioning portion provided in the main assembly of the apparatus to limit rotation of the process cartridge about the first cartridge positioning portion, when the driving input gear receives the rotational driving force from the main assembly driving gear, wherein in a state in which the process cartridge is set in the main assembly of the apparatus, the coupling member being located at a position to cross a phantom line which is perpendicular to the second main assembly positioning portion abutting the second positioning portion and which passes through said second positioning portion, as seen from one end with respect to the axis.

According to another aspect of the present invention, there is provided an electrophotographic image forming apparatus for forming an image on a recording material, to which a process cartridge is detachably mountable, said apparatus comprising (a) a first main assembly positioning portion: (b) a second main assembly positioning portion; (c) a main assembly driving gear; and (d) mounting means for detachably mounting a process cartridge. The process cartridge including an electrophotographic photosensitive drum, a developing roller for developing an electrostatic latent image formed on an electrophotographic photosensitive drum, a first frame supporting the electrophotographic photosensitive drum, a second frame supporting the developing roller, a coupling member for rotatably coupling the first frame and the second frame, a first cartridge positioning portion which is provided at each of one and the other longitudinal end portions of the process cartridge and which is abuttable to the first main assembly positioning portion provided in the main assembly of the apparatus to position the process cartridge with respect to a direction crossing a direction of an axis of the electrophotographic photosensitive drum, when the process cartridge is mounted to the main assembly of the apparatus; a driving input gear, provided at one of the longitudinal end portions, for engagement with the main assembly driving gear provided in the main assembly to receive a rotational driving force for rotating the developing roller; a second cartridge positioning portion which is provided at one longitudinal end portion of the process cartridge and which is abuttable to a second main assembly positioning portion provided in the main assembly of the apparatus to limit rotation of the process cartridge about the first cartridge positioning portion, when the driving input gear receives the rotational driving force from the main assembly driving gear, wherein in a state in which the process cartridge is set in the main assembly of the apparatus, the coupling member is located at a position to cross a phantom line which is perpendicular to the second main assembly positioning portion abuttable to the second positioning portion and which passes through the second positioning portion, as seen from one end with respect to the axis; the apparatus further comprising (e) feeding means for feeding the recording material.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First Embodiment

A description will be provided as to a process cartridge and an electrophotographic image forming apparatus according to an embodiment of the present invention in conjunction with the accompanying drawings.

(General Arrangement of Image Forming Apparatus)

Figure 1:
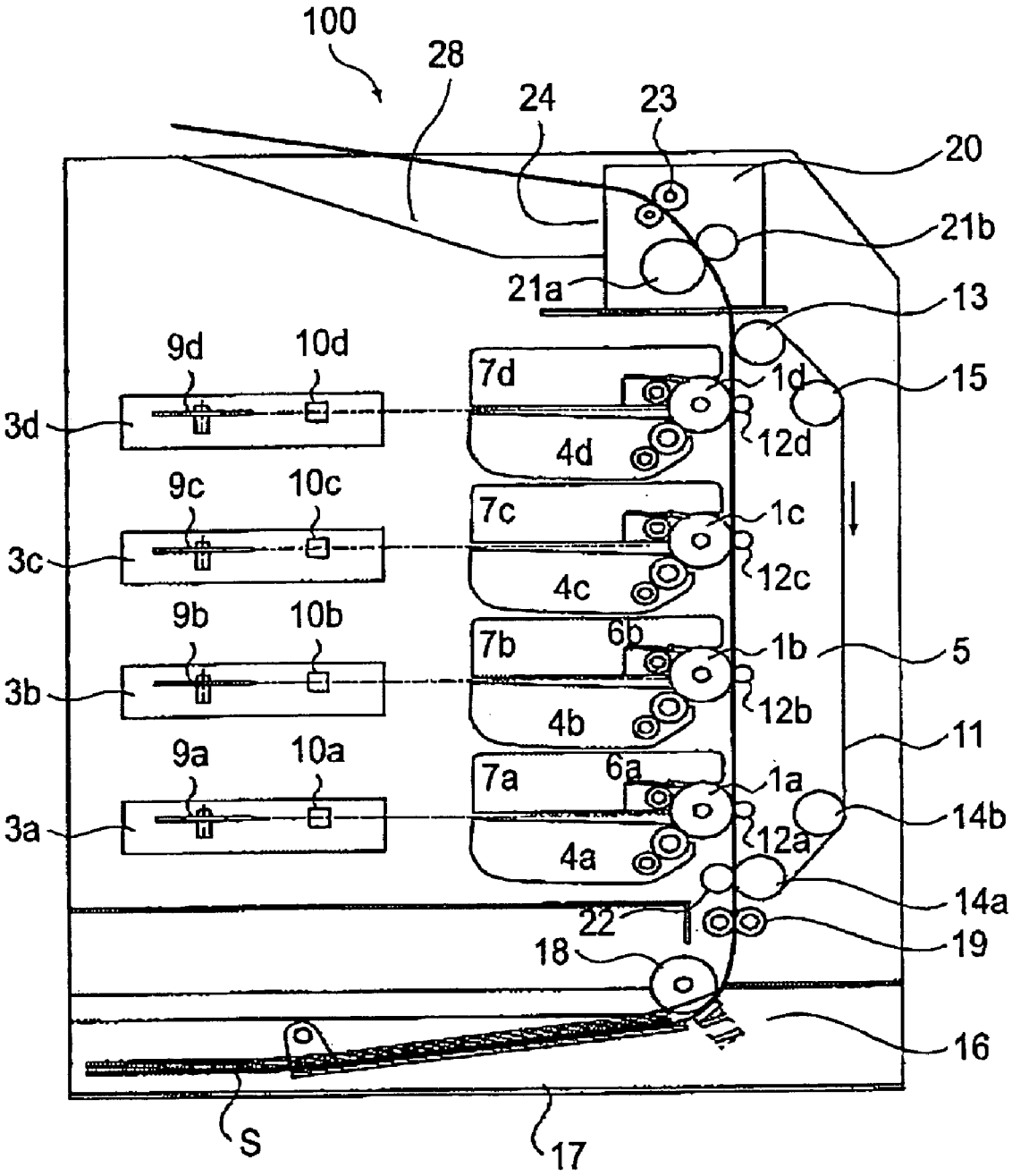
FIG. 1 is a sectional view of an example of a multi-color image forming apparatus according to an embodiment of the present invention.

Referring to FIG. 1, a description will first be provided as to the general arrangement of the multi-color image forming apparatus. FIG. 1 is a longitudinal sectional view illustrating a general arrangement of a full-color laser beam printer 100 which is an example of a multi-color image forming apparatus.

The multi-color image forming apparatus 100 shown in this figure includes four photosensitive drums 1*a*, 1*b*, 1*c*, 1*d* which are arranged substantially vertically. The photosensitive drum 1 is rotated in the counterclockwise direction in the figure by a driving means (unshown). Around the photosensitive drum 1, there are provided charging means 2 (2*a*, 2*b*, 2*c*, 2*d*) for electrically charging the associated photosensitive drum 1 to a uniform potential, a scanner unit (3*a*, 3*b*, 3*c*, 3*d*) for forming an electrostatic latent image on the photosensitive drum 1 by exposing it with a laser beam modulated in accordance with image information, and a developing unit 4 (4*a*, 4*b*, 4*c*, 4*d*) for developing the electrostatic latent image with a developer, electrostatic transferring means 5 for transferring the toner image provided by the development from the photosensitive drum 1 onto a recording material S, and cleaning means (6*a*, 6*b*, 6*c*, 6*d*) for removing untransferred toner remaining on the surface of the photosensitive drum 1 after the image transfer, in the order named.

In this embodiment, the photosensitive drum 1, the charging means 2, developing unit 4 and the cleaning means are contained in a cartridge 7 as a unit.

Figure 2:
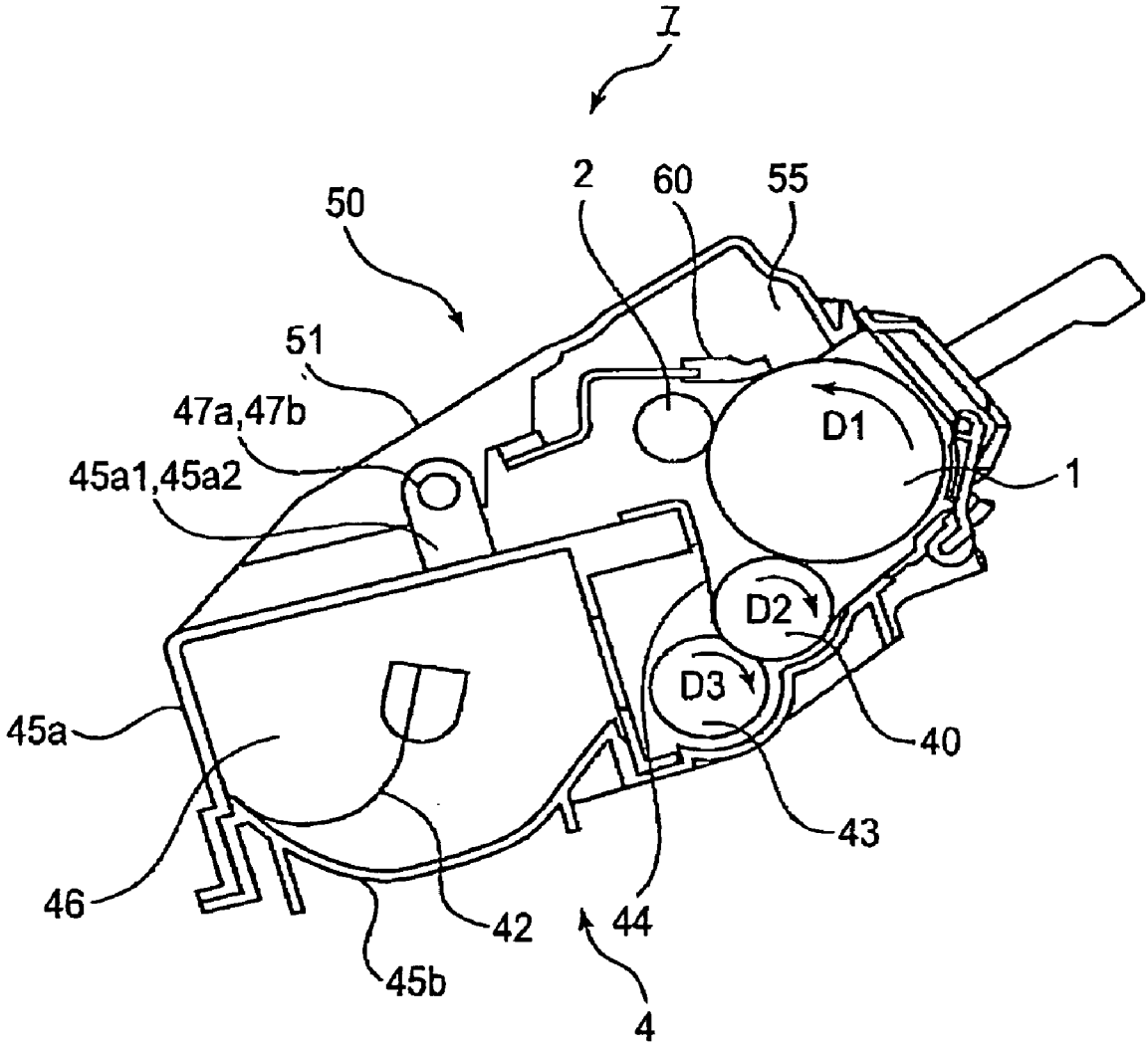
FIG. 2 is a sectional view of a process cartridge according to an embodiment of the present invention.
Figure 3:
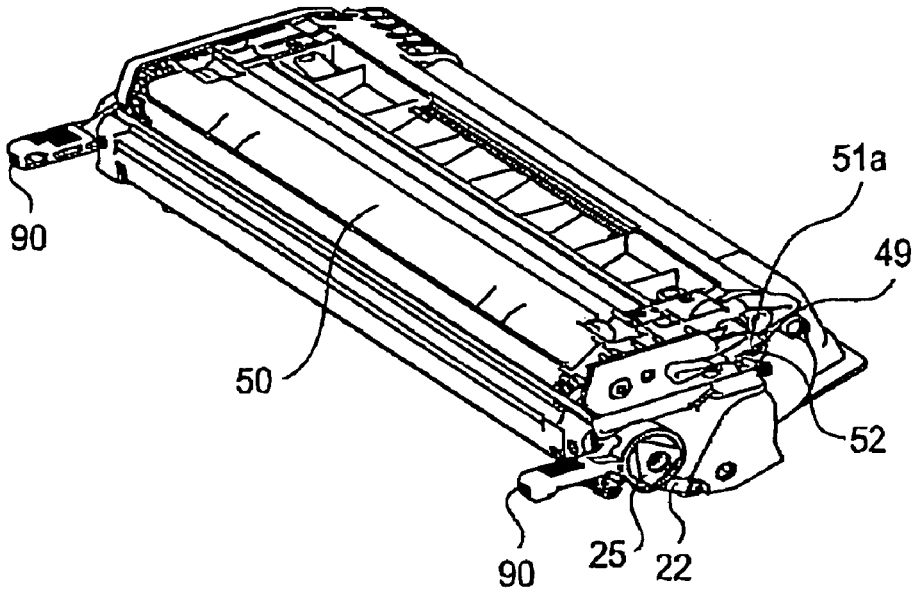
FIG. 3 is a perspective view of a process cartridge according to an embodiment of the present invention.
Figure 3:
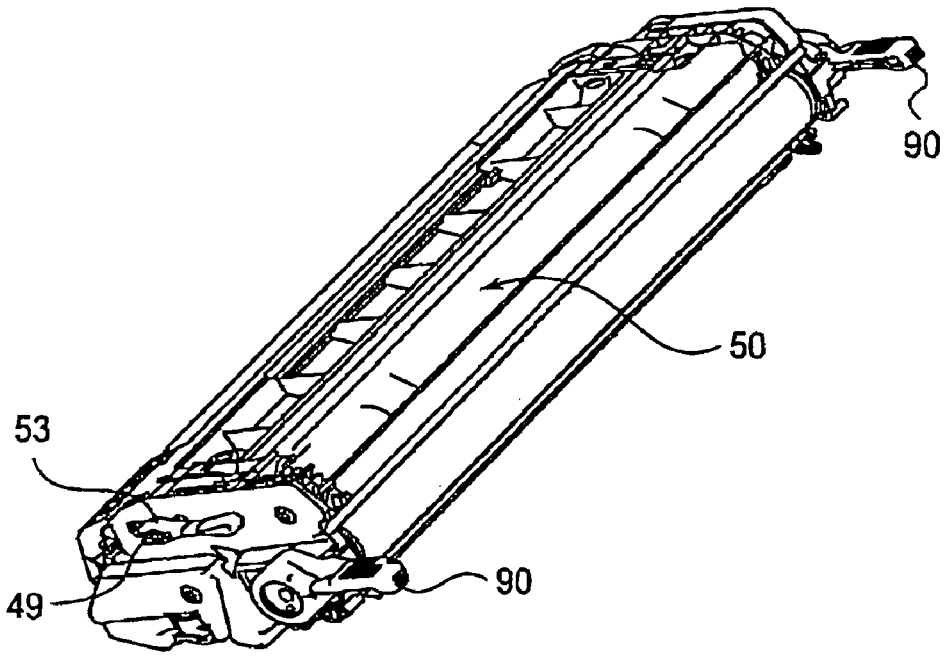

The photosensitive drum 1 has a photosensitive layer on an outer surface of an aluminum cylinder, for example. The photosensitive drum 1 is rotatably supported on a cleaning frame 51 (first frame) by end supporting members (unshown) at the opposite ends thereof. At one axial end of the photosensitive drum 1 (longitudinal end of the cartridge 7), there is provided a coupling member 25 mounted thereto as shown in FIG. 3. A driving force is transmitted from a driving motor (unshown) to the coupling member 25 through a main assembly coupling (unshown). As shown in FIG. 2, the photosensitive drum 1 is rotated in the couter-clockwise direction as indicated by arrow D1.

In this embodiment, a contact charging type charging means 2 (2*a*, 2*b*, 2*c*, 2*d*) is used. The charging means 2 is in the form of an electroconductive roller, which is contacted to the peripheral surface of the photosensitive drum 1. The roller 2 is supplied with a charging bias voltage. By this, the peripheral surface of the photosensitive drum 1 is uniformly charged. In this embodiment, the use is made with a reverse development, and therefore, the peripheral surface of the photosensitive drum 1 is charged to the negative polarity.

The scanner unit (3*a*, 3*b*, 3*c*, 3*d*) is disposed substantially at the same levels as the associated photosensitive drum 1 and is extended substantially in a horizontal direction. The image light produced by a laser diode (unshown) corresponding to an image signal is projected onto a polygonal mirror (9*a*–9*d*) which is rotated at a high speed by a scanner motor (unshown). The image light reflected by the polygonal mirror is projected on the surface of the photosensitive drum 1 which has been electrically charged, through an imaging lens (10*a*, 10*b*, 10*c*, 10*d*). By the imagewise exposure of the photosensitive drum to the image light, an electrostatic latent image is formed in accordance with the image signal.

As shown in FIG. 2, the developing units 4 (4*a*, 4*b*, 4*c*, 4*d*) contain yellow color, magenta color, cyan color and black color developers (toner particles) in respective toner containers. The toner is supplied to an associated toner supplying roller 43 by a toner feeding mechanism 42 provided in toner accommodating container 46. The toner supplying roller 43 rotates in the clockwise direction (arrow D3 direction) in the figure to supply the toner to the developing roller 40, which effects the development of the photosensitive drum 1. The toner supplying roller 43 removes the toner from the developing roller 40 after the development. Then, toner supplied to the developing roller 40 is applied on the outer surface of the developing roller 40 which is rotating in the clockwise direction in the figure, by a developing blade 44 press-contacted to the outer surface of the developing roller 40. The developing roller 40 is supplied with a developing bias voltage to develop the latent image on the photosensitive drum 1 into a toner image. The rotational axis of the developing roller 40 is parallel with the axis of the photosensitive drum 1.

On the other hand, as shown in FIG. 1, the image forming apparatus 100 includes an electrostatic transfer belt 11 which makes a circulation movement by all of the photosensitive drums 1*a*–1*d*. The transfer belt 11 is an electrostatic conveyer belt made of resin film, a multi-layer film having a rubber base layer and a resin material layer thereon. While the belt 11 circulates, it electrostatically attracts the recording material S on the outer surface at the left side in FIG. 1 and contacts the recording material S to the photosensitive drum 1. The recording material S is fed to the image transfer station by the transfer belt 11, where the toner image is transferred from the photosensitive drum 1 onto the recording material S.

Transfer rollers (12*a*, 12*b*, 12*c*, 12*d*) are disposed in the electrostatic transfer belt 11 which is an endless belt, and is contacted to the inside of the electrostatic transfer belt 11 at a position opposed to the associated photosensitive drum (1*a*, 1*b*, 1*c*, 1*d*). The transfer rollers apply charge of positive polarity to the recording material S through the electrostatic transfer belt 11. By this, the toner image is transferred from the photosensitive drum 1 onto the recording material S.

A feeding portion 16 functions to feed the recording material S to such an image forming station. Here, a cassette 17 accommodates a plurality of recording materials S. During the image forming operation, a feeding paper roller 18 (crescent roller) and registration roller 19 are rotated in accordance with the image forming operation. By this, the recording material S in the cassette 17 is fed out one by one. A leading end of the recording material S is abutted to the registration roller 19, and is temporarily stops to form a loop. The recording material S is fed to the electrostatic transfer belt 11 in timed relation with the rotation of the electrostatic transfer belt 11 and the image writing position by the registration roller 19.

The fixing portion 20 functions to fix the toner images of different colors having been transferred onto the recording material S. The fixing portion 20 includes a rotatable heating roller 21*a* and a pressing roller 21*b* press-contacted thereto to apply heat and pressure to the recording material S. The recording material S having the toner image transferred from the photosensitive drum 1, is fed by the pressing roller 21*b* in the nip of the fixing portion 20, provided by the heating and pressing rollers 21*a* and 21*b*. In the fixing portion 20, the recording material is pressed and heated by the pressing roller 21*b* and the heating roller 21*a*. By doing so, the toner image comprising toner particles having a plurality of colors is fixed on the surface of the recording material S.

The image forming operation is as follows.

The cartridges 7*a*, 7*b*, 7*c*, 7*d* are sequentially rotated in timed relation with the image forming operation. By this, the photosensitive drums (1*a*, 1*b*, 1*c*, 1*d*) are rotated in response thereto. The scanner unit is sequentially actuated corresponding to the cartridges. By the actuation, the charging roller 2 applies uniform charge on the peripheral surface of the photosensitive drum 1. The scanner unit exposes the peripheral surface of the photosensitive drum 1 in accordance with image signal to form an electrostatic latent image on the peripheral surface of the photosensitive drum 1. The developing roller 40 in the developing unit 4 transfers the toner to a low potential portion of the electrostatic latent image, thus forming a toner image on the peripheral surface of the photosensitive drum 1.

As described in the foregoing, the toner image is sequentially transferred from the photosensitive drums 1 onto the recording material S by the electric fields formed between the photosensitive drums 1 and the transfer rollers (12*a*, 12*b*, 12*c*, and 12*d*).

The recording material S onto which the toner image has been transferred, is separated from electrostatic transfer belt 11 by the belt driving roller 13 using the curvature of the belt driving roller 13, and is fed into the fixing portion 20. The recording material S is subjected to the heat fixing operation of the fixing portion 20 so that the toner image is fixed, and then is discharged from a discharging portion 24 onto the tray 28 with the image side facing down.

(Structure of Process Cartridge)

Referring to FIGS. 2 and 3, a description will be made in detail as to the process cartridge (cartridge) according to an embodiment of the present invention. FIGS. 2 and 3 are, respectively a main section and a perspective view of the cartridge 7 accommodating the developer. The cartridges 7*a*, 7*b*, 7*c*, 7*d* for yellow color, magenta color, cyan color and black color have substantially or exactly the same structure.

The cartridge 7 comprises a cleaner unit 50 containing the electrophotographic photosensitive drum 1 (photosensitive drum 1), the charging means and the cleaning means, and a developing unit 4 containing the developing roller for developing the electrostatic latent image on the photosensitive drum 1.

In the cleaner unit 50, the photosensitive drum 1 is rotatably mounted to the cleaning frame 51 (first frame) through bearing members 31. The photosensitive drum 1 has a photosensitive layer on the outer surface thereof. Around the photosensitive drum 1, there are provided a charging means 2 for electrically charging the photosensitive layer to a uniform potential, a cleaning blade 60 for removing the toner remaining on the photosensitive drum 1 after the image transfer, and a flexible sheet. The charging means 2, the cleaning blade 60 and the flexible sheet are supported by the cleaning frame 51. The toner removed from the surface of the photosensitive drum 1 by the cleaning blade 60 is sequentially fed to a residual toner chamber 55 provided at a rear side of the cleaning frame 51.

The developing unit 4 contains a developing roller 40 rotating with a small gap from the photosensitive drum 1 and a developing device frame 45 (second frame). The developing roller 40 is rotatable in the direction indicated by arrow D2.

The developing device frame 45 comprises an upper frame 45*a* and a lower frame member 45*b*. The upper frame 45*a* and the lower frame member 45*b* are welded by ultrasonic welding to constitute a toner accommodating portion 46 for accommodating the toner.

To the developing roller 40, the toner supplying roller 43 and the developing blade 44 are contacted. The toner supplying roller 43 is rotatable in the direction indicated by arrow D3. In the toner accommodating container 46, there is provided a toner feeding mechanism 42 for stirring and feeding the toner to the toner supplying roller 43.

Figure 8:
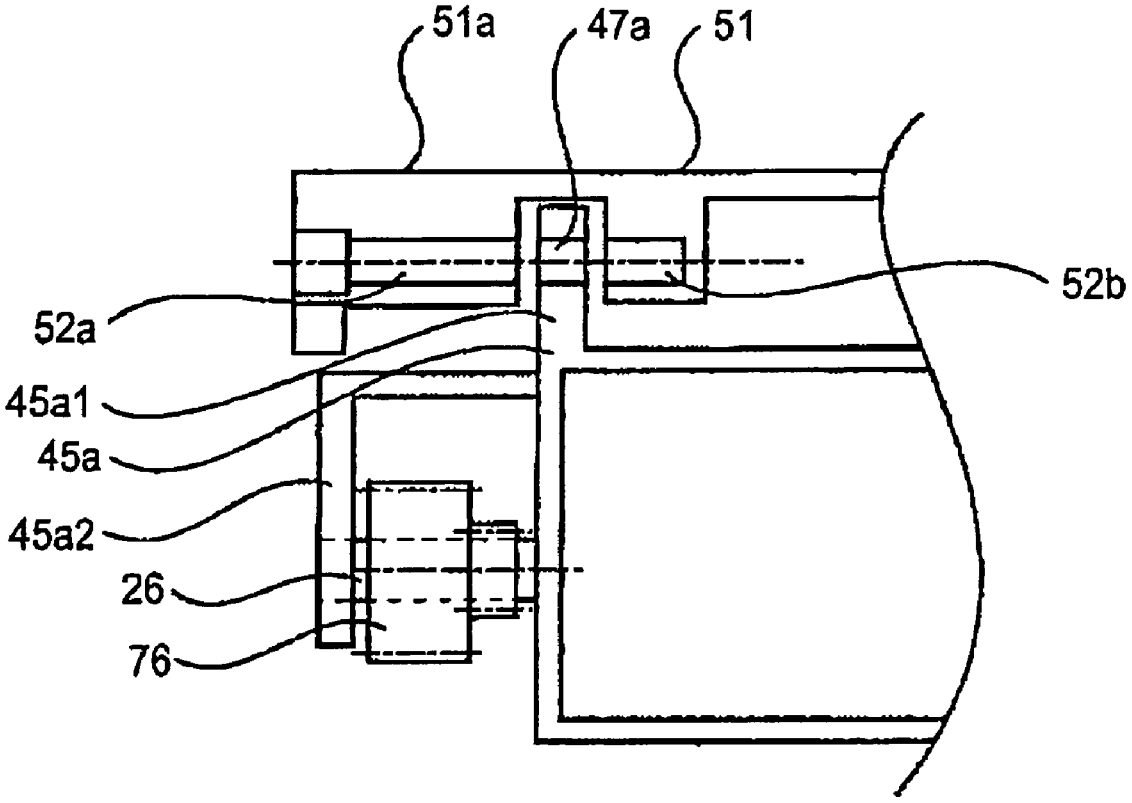
FIG. 8 is a sectional view of a process cartridge according to an embodiment of the present invention.
Figure 9:
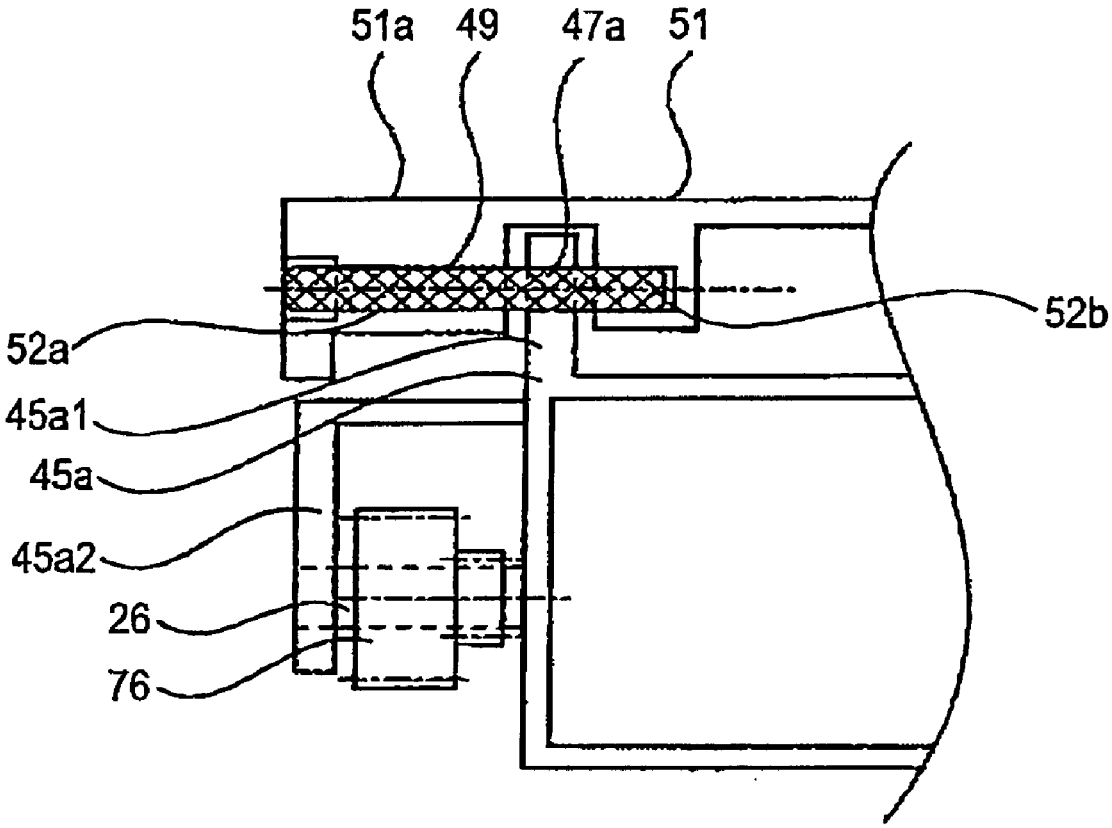
FIG. 9 is a sectional view of a process cartridge according to an embodiment of the present invention.
Figure 10:
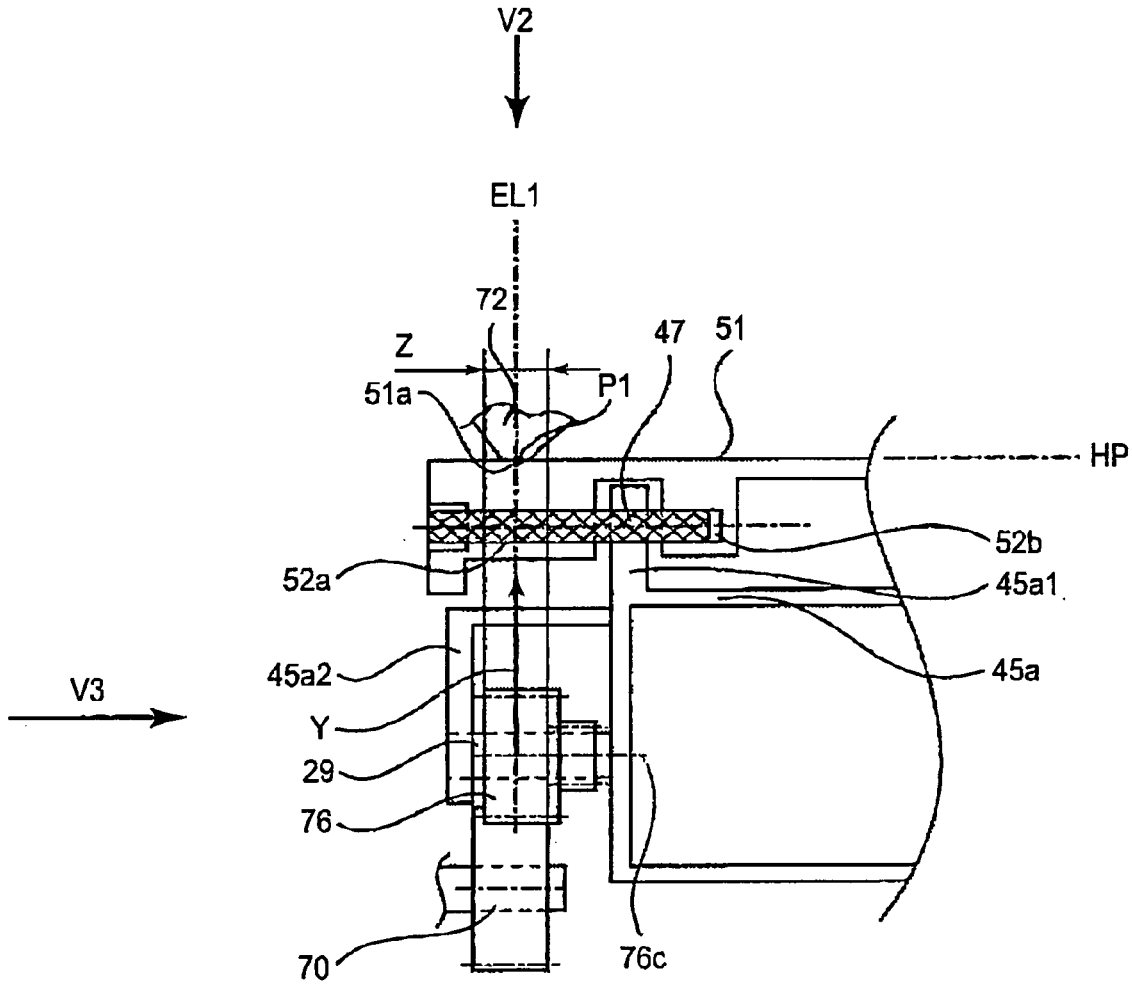
FIG. 10 is a sectional view of a process cartridge according to an embodiment of the present invention.

The developing unit 4, as shown in FIG. 8–FIG. 10, is supported rotatably on the cleaner unit 50. As shown in FIG. 8, one end of the developing device frame 45 is provided with an arm 45*a*1. The arm 45*a*1 is provided with a hole 47*a* which functions as an engaging portion. The cleaning frame 51 of the cleaner unit 50 is also provided at one end with a hole 52*a*. As shown in FIG. 9, a pin 49 (coupling member) having a circular section is penetrated through the holes 52*a*, 47*a*, 52*b* in this order, so that the cleaning frame 51 and the developing device frame 45 are rotatably connected with each other. Namely, the pin 49 is supported by the hole 52*a* and the hole 52*b* (supporting portion). In this embodiment, the pin 49 is inserted, and thereafter, the pin 49 is fixed in the hole 52*a* by an adhesive material. The pin 49 extends parallel to the rotational axis of the photosensitive drum 1.

Figure 14:
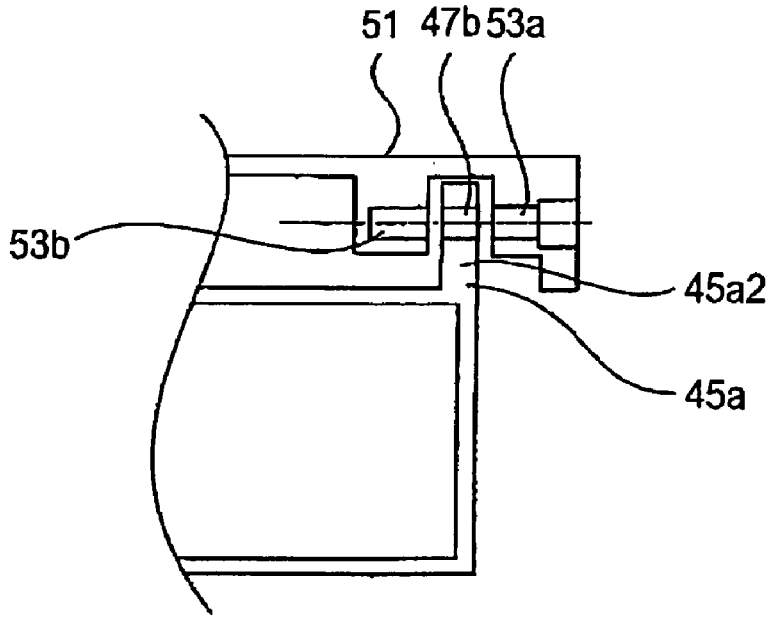
FIG. 14 is a sectional view of a process cartridge according to an embodiment of the present invention.
Figure 14:
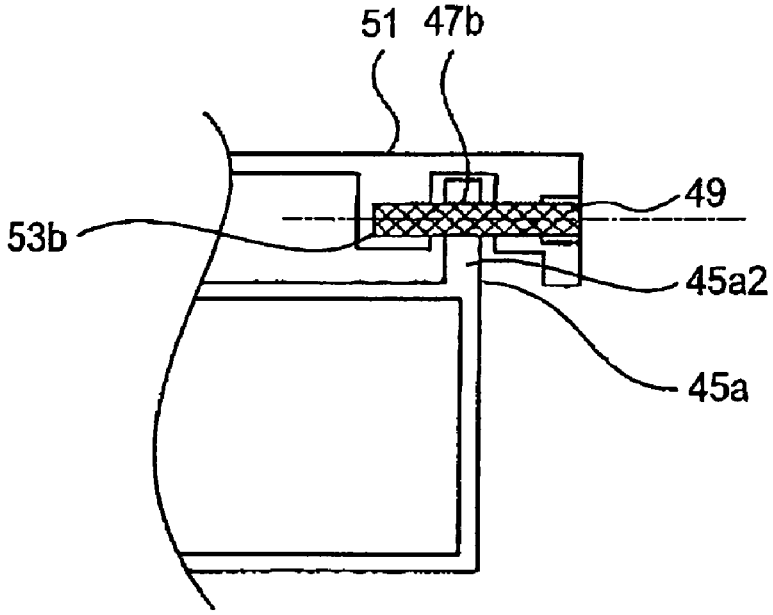

Similarly, as shown in FIGS. 14*a*, 14*b*, at the other side of the cartridge 7, a pin 49 is inserted through a hole 47*b* formed in other end of the developing device frame 45, and the holes 53*a*, 53*b* formed in the other end of the cleaning frame 51. The developing unit 4 is normally urged by a pressing spring 22 so that developing roller 40 is contacted to the photosensitive drum 1.

During the developing operation, the toner accommodated in the toner accommodating container 46 is fed to the toner supplying roller 43 by the toner stirring mechanism 42. The toner supplying roller 43 rotating in the direction indicated by an arrow D3 is in rubbing relation with the developing roller 40 rotating in the direction indicated by arrow D2, so that toner is supplied to the developing roller 40 to deposit the toner on the peripheral surface of the developing roller 40. The toner deposited and carried on the peripheral surface of the developing roller 40 is moved to the developing blade 44 with the rotation of the developing roller 40. The developing blade 44 regulates toner to form a predetermined thin toner layer while applying a desired amount of the charge to the toner. The thin layer of the toner thus provided on the developing roller 40 is fed to the developing zone where the developing roller 40 is close to the photosensitive drum 1. The toner is deposited onto the electrostatic latent image formed on the surface of the photosensitive drum 1 by a developing bias applied to the developing roller 40 from a voltage source (unshown) in the developing zone, thus forming a developed image.

The toner not used for the development and remaining on the surface of the developing roller 40 is returned into the developing device with the rotation of the developing roller 40. The toner is removed from the developing roller 40 at the sliding portion which the developing roller 40 is in sliding relation with the toner supplying roller 43 and is collected. The collected toner is stirred and mixed with the other toner by the toner stirring mechanism 42.

(Mounting and Demounting of the Process Cartridge Relative to the Main Assembly of the Image Forming Apparatus)

Figure 4:
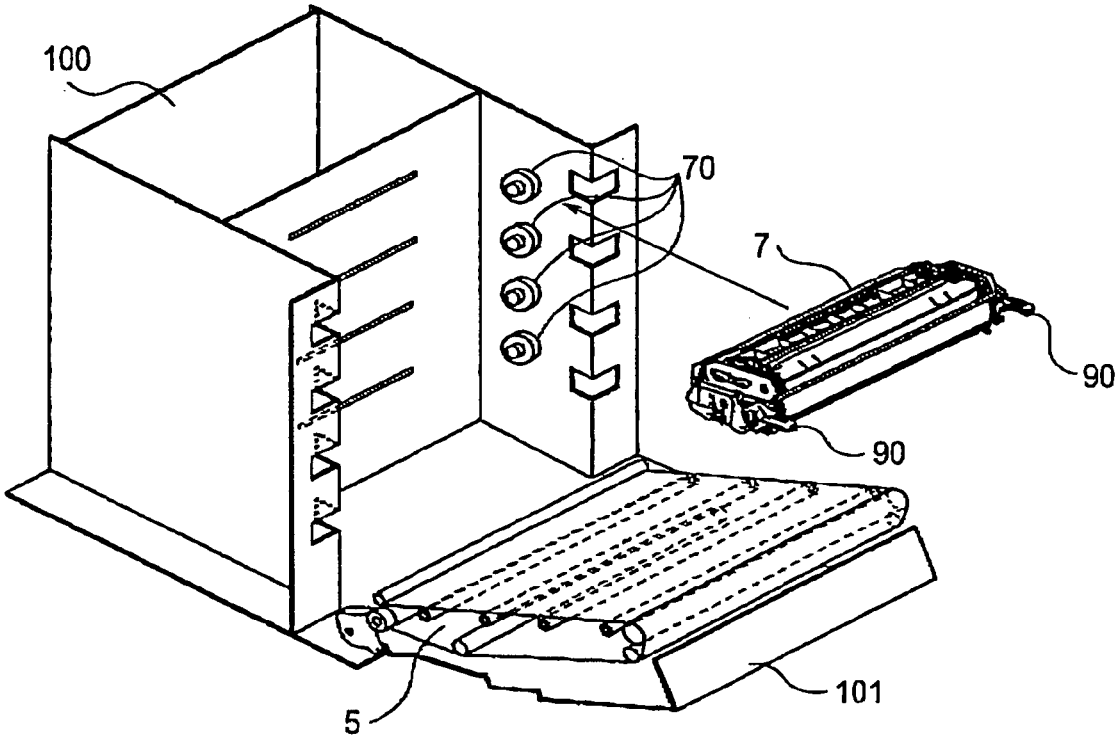
FIG. 4 is a schematic perspective view of the main assembly of the image forming apparatus in which the process cartridge is mounted thereto according to an embodiment of the present invention.

Referring to FIG. 4, a description will be provided as to the mounting and demounting method of the cartridge 7 relative to the main assembly 100 of the image forming apparatus. As shown in FIG. 4, the main assembly 100 of the image forming apparatus is provided with a front door 101 which is rotatable relative to the main assembly 100. On the front door 101, the electrostatic transferring means 5 is rotatably supported. When the front door 101 is opened, the cartridge 7 is capable of being mounted and demounted relative to the main assembly 100 of the image forming apparatus. Adjacent the photosensitive drum supporting portion at the respective ends of the cartridge 7, there are provided grip members 90 which facilitate the mounting and demounting of the cartridge 7. The cartridge 7 is mounted to the main assembly 100 of the image forming apparatus while engaging a guide portion (unshown) of the cartridge 7 on a guiding rail portion (unshown) provided in the main assembly 100 of the image forming apparatus.

(Positioning of Process Cartridge)

Figure 5:
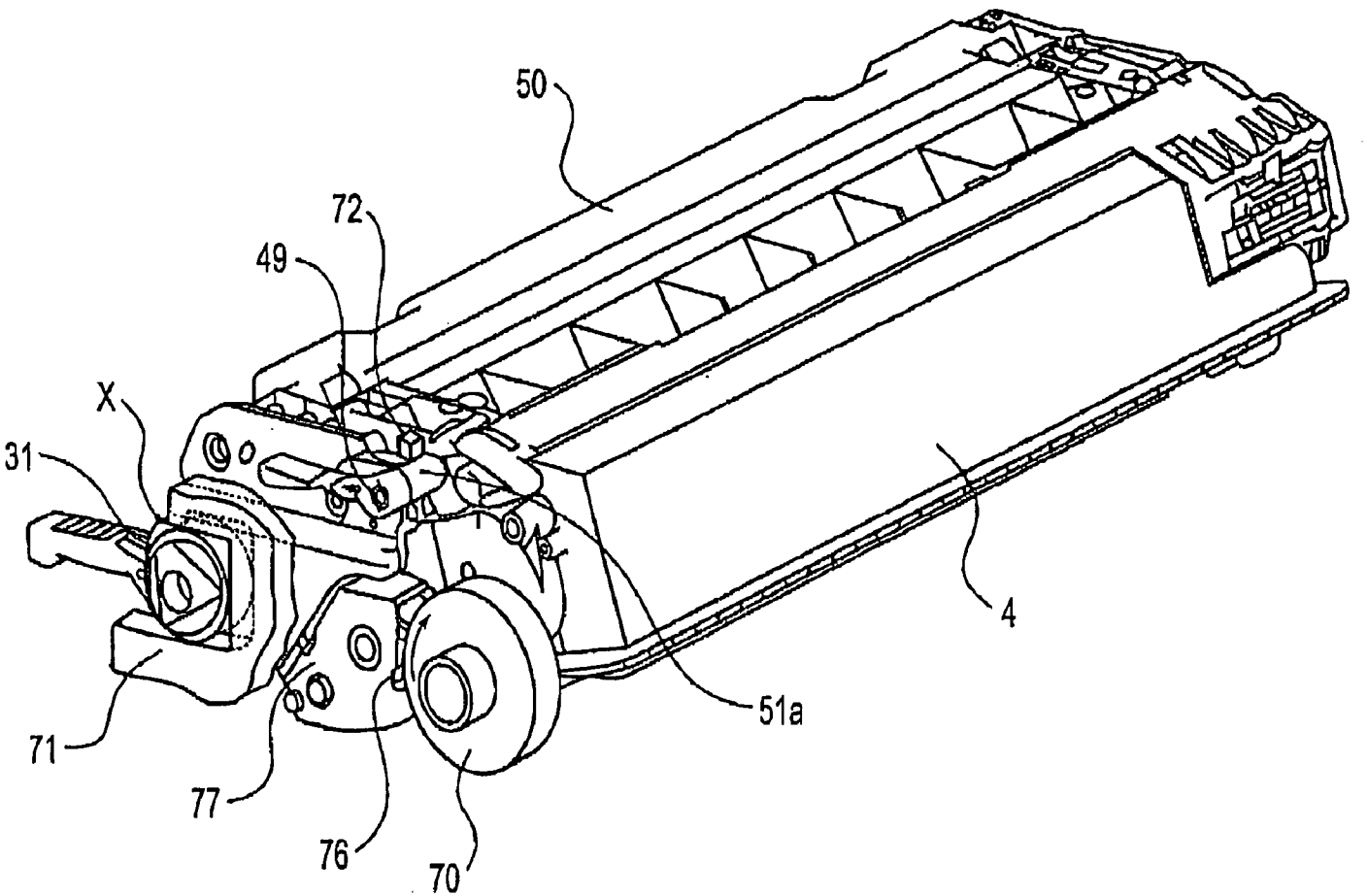
FIG. 5 is a perspective view of a process cartridge according to an embodiment of the present invention.
Figure 6:
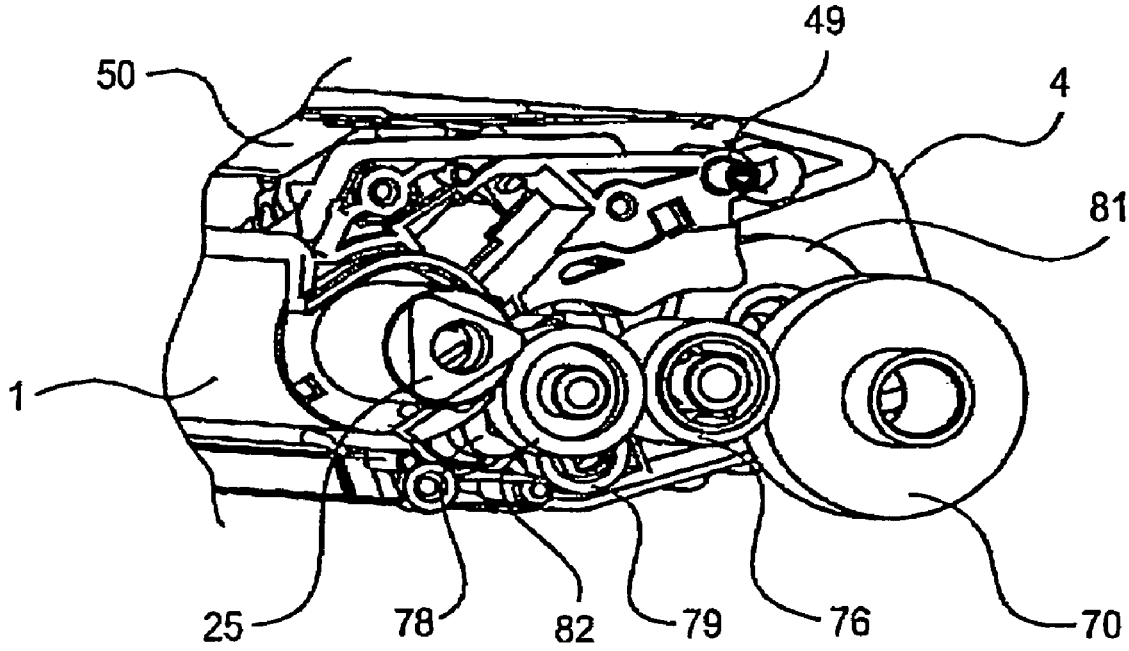
FIG. 6 is a perspective view of a process cartridge according to an embodiment of the present invention.
Figure 7:
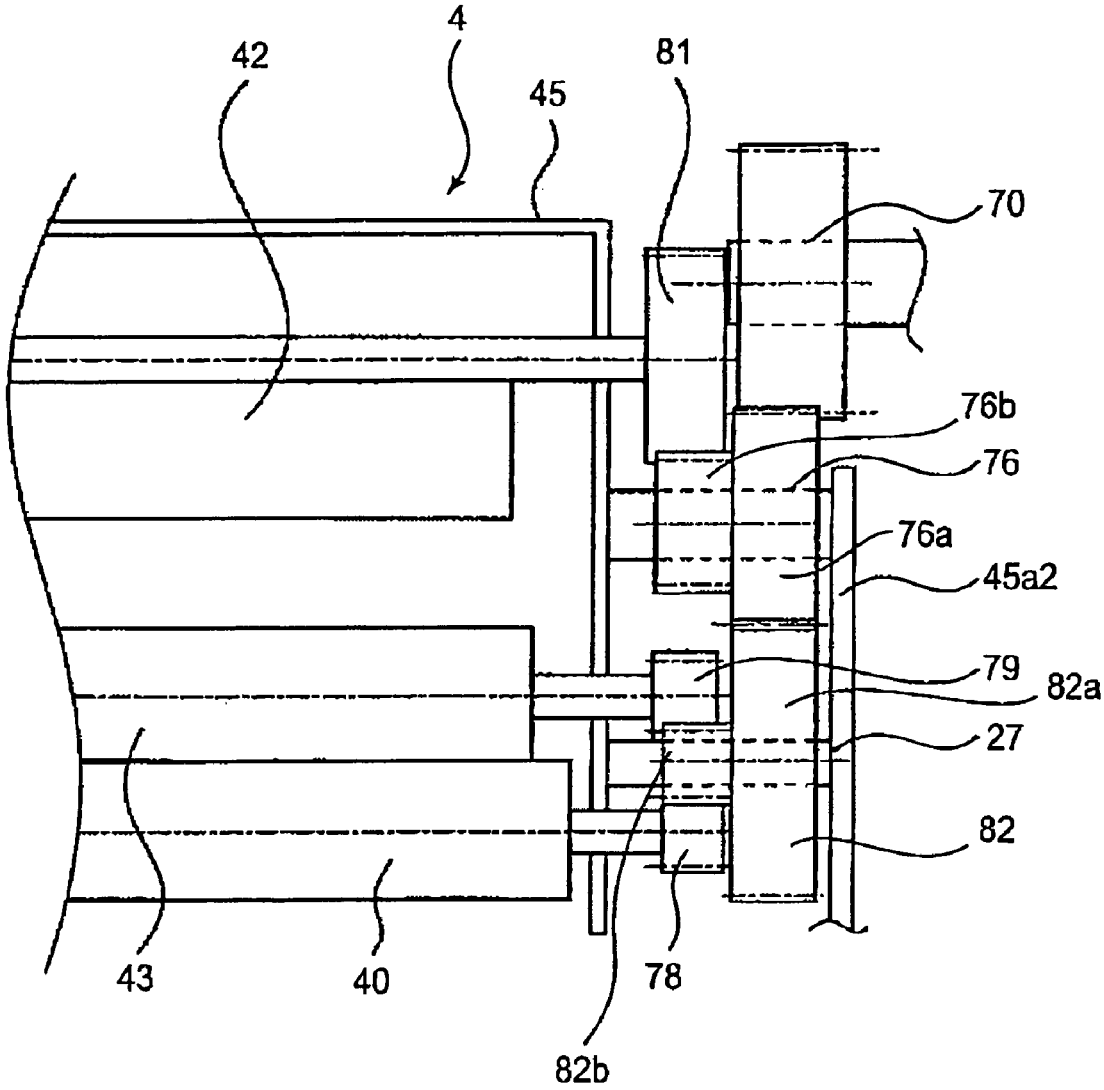
FIG. 7 is a sectional view of a drive transmission path according to an embodiment of the present invention.

As shown in FIGS. 5–7, the driving input gear 76 provided in the developing unit is engaged with the driving gear 70 provided in the main assembly 100 of the image forming apparatus to transmit the driving force. The driving force received by the driving input gear 76 is transmitted to the developing roller 40, the toner supplying roller 43, and the toner feeding mechanism 42 in the developing unit 4. By doing so, the developing roller 40, the toner supplying roller 43 and the toner feeding mechanism 42 are rotated. Referring to FIGS. 6 and 7, a description will be provided as to the driving force transmission path. The driving input gear 76 for receiving the rotational driving force from the driving gear 70 has two gears 76*a* and 76*b* which are coaxial. The driving input gear 76 is rotatably supported on a supporting shaft 26. One end of the supporting shaft 26 is supported on the developing device frame 45. The other end of the supporting shaft 26 is supported on the supporting portion 45*a*2. Furthermore, the developing device frame 45 supports by a supporting shaft 27 an idler gear 82, which receives the driving force from the driving input gear 76. The idler gear 82 has two coaxial gears 82*a* and 82*b*. The gear 76*b* is in meshing engagement with a toner feeding mechanism gear 81 for rotating the toner feeding mechanism 42 to transmit the rotational driving force. The gear 76*a* is in meshing engagement with the gear 82*a* to transmit the rotational driving force to the idler gear 82. In addition, the gear 82*b* is engaged with a toner supplying roller gear 79 for rotating the toner supplying roller 43 and a developing roller gear 78 for rotating the developing roller 40 to transmit the driving force to the developing roller 40.

Figure 11:
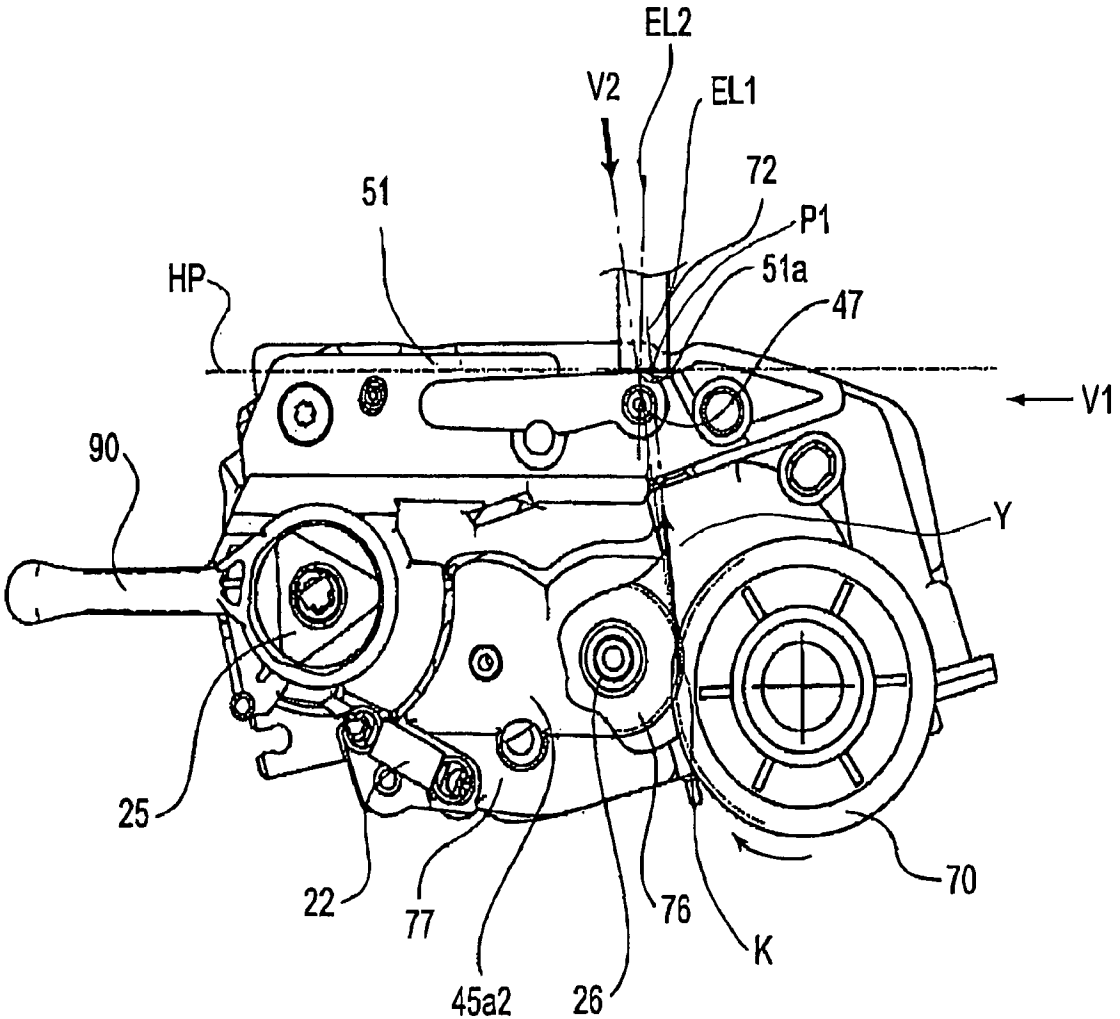
FIG. 11 is a side view of a process cartridge according to an embodiment of the present invention.

Thus, the rotational driving force from the driving gear 70 rotates the developing roller 40, the toner supplying roller 43 and the toner feeding mechanism 42, and the torque required for rotating them all is quite large. Therefore, as shown in FIG. 11, the input gear 76 receives a force Y corresponding to the torque at the engaging portion K between the driving gear 70 and the driving input gear 76.

Referring to FIGS. 5, 10, a description will be provided as to the structure by which the cleaner unit 50 supporting the developing unit 4 which receives the force Y is supported by the main assembly 100 of the image forming apparatus.

The cleaner unit 50 rotatably supporting the developing unit 4 is abutted against a supporting portion 71 (i.e., a first main assembly positioning portion) of the main assembly 100 with a support force X from the main assembly 100 of the image forming apparatus at the outer periphery of the bearing member 31 (first cartridge positioning portion), which functions to rotatably support the photosensitive drum 1. The structure is the same at the other end with respect to axial direction of the photosensitive drum 1. With this structure, the cartridge 7 can be correctly positioned with respect to a direction crossing the longitudinal direction of the cartridge 7. As shown in FIGS. 5 and 11, the cartridge 7 receives the force Y at the driving input gear 76 by the rotational driving force from the driving gear 70, as described hereinbefore. Therefore, the cartridge 7 receives a force tending to rotate about the bearing member 31, and a second cartridge positioning portion 51*a* of the cleaning frame 51 is abutted to a supporting portion 72 (i.e., a second main assembly positioning portion) provided in the main assembly 100 of the image forming apparatus. In other words, the rotation of the cartridge 7 about the bearing member 31 is limited by the second supporting portion 72. By doing so, the cartridge 7 is positioned in place relative to the main assembly 100 of the apparatus.

Figure 15:
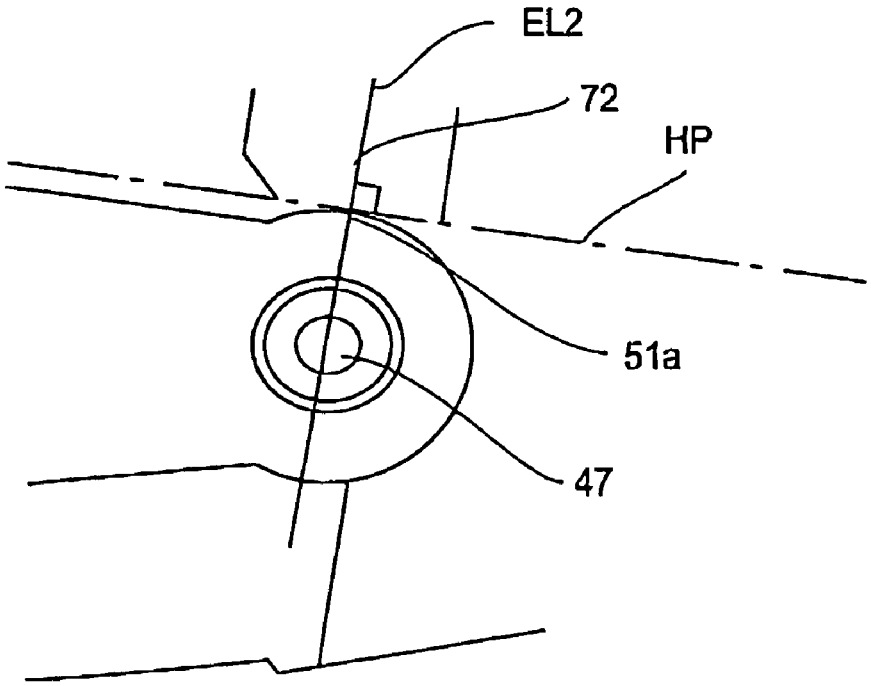
FIG. 15 is a sectional view of a process cartridge according to an embodiment of the present invention.
Figure 15:
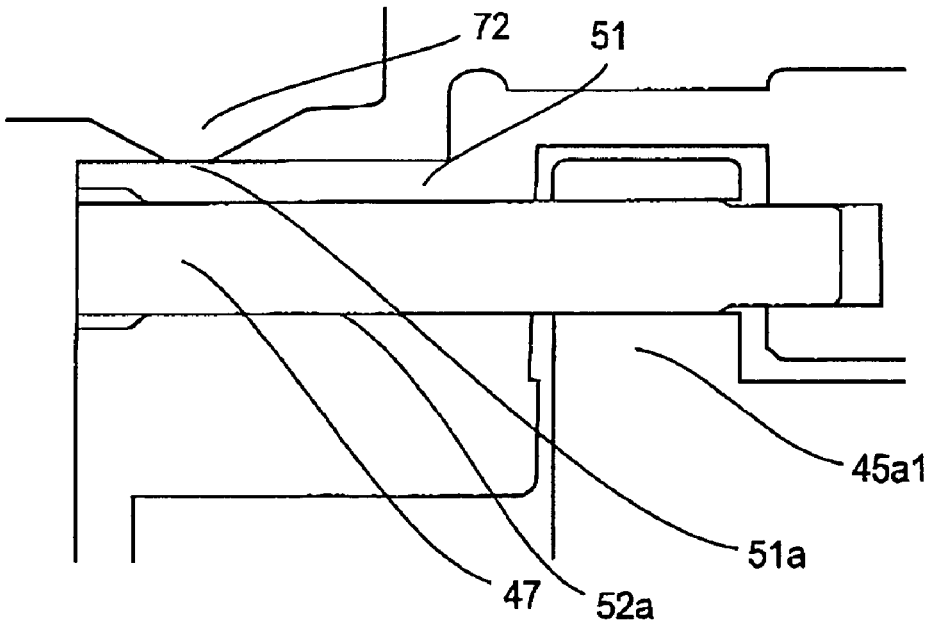

FIG. 15(*a*) is a detailed illustration of the supporting portion 72 and the second cartridge positioning portion 51*a* as seen in the longitudinal direction of the cartridge 7 (a direction of the axis of the photosensitive drum 1). FIG. 15(*b*) is a detailed illustration of the second supporting portion 72 and the cartridge positioning portion 5 as seen in a direction perpendicular to the longitudinal direction of the cartridge 7 (the direction of the axis of the photosensitive drum 1). The supporting portion 72 has a flat surface configuration to provides a reference surface HP. The cartridge 7 is positioned by abutting to the supporting portion 72 at the cartridge positioning portion 51*a*.

(Positional Relation Between the Driving Input Gear and Positioning Portion)

FIGS. 10 and 11 show the positional relation between driving input gear 76 and the positioning portion 51*a*. FIG. 10 is a view as seen in the direction V1 in FIG. 11. The direction V1 is parallel with the reference surface HP. As will be understood from these figures, when the cartridge 7 is seen in the direction V1 perpendicular to the longitudinal direction of the cartridge 7 (the direction of the axis of the developing roller 40), the positioning portion 51*a* is included in an engagement width (engagement range) Z between the driving input gear 76 and the driving gear 70. Then, the relation between the positioning portion 51*a* and the force Y is as follows. As shown in FIG. 11, the force Y is expressed as a vector having a starting point at the engaging portion K between the driving input gear 76 and the driving gear 70 and having an orientation which is upward when the cartridge 7 is mounted to the main assembly 100 of the image forming apparatus. An extension line EL1 of the force Y intersects the reference surface HP at point P1. In the longitudinal direction of the cartridge 7, the positional relation of the force Y and the positioning portion 51*a* is as shown in FIG. 10. The force Y is a vector having a starting point at a center of the engagement range Z (a point Z/2 away from the end of the driving input gear 76) between the driving input gear 76 and the driving gear 70. An extension line EL1 of the force Y is at such a position overlapping with the positioning portion 51*a* with respect to the direction perpendicular to the longitudinal direction of the cartridge 7 as seen in the direction V1.

In other words, the positional relation between the driving input gear 76 and the positioning portion 51*a* is as follows. As shown in FIGS. 10 and 11, the engagement range Z in the longitudinal direction is seen in a direction which is perpendicular to the longitudinal direction and which passes through the second cartridge positioning portion 51*a*. Then, the engagement range Z is at a position overlapping with the second cartridge positioning portion 51*a*.

The positional relation is described as follows. The longitudinal engagement range Z shown in FIGS. 10 and 11 is projected on the axis 76*c* of the driving input gear 76. When the projected range (projection range) is seen in a direction (unshown) which is perpendicular to the longitudinal direction and which passes through the cartridge positioning portion 51*a*, the projection range overlaps the cartridge positioning portion 51*a*.

Furthermore, the driving input gear 76, as seen in the direction V1, overlaps at least a part of the positioning portion 51*a*, with respect to the longitudinal direction of the cartridge 7.

With this structure, even when the cartridge 7 receives the rotational driving force at the driving gear 70, the cleaning frame 51 is not subjected to a moment about the positioning portion 51*a*, as shown in FIG. 10. Therefore, deformation of the cleaning frame 51 is suppressed, so that the cartridge 7 can be properly positioned relative to the main assembly 100 of the apparatus. The deformation of the developing device frame 45 supported rotatably to the cleaning frame 51 can be suppressed. In this manner, the positioning accuracies of the developing roller 40 and the toner supplying roller 43 relative to the photosensitive drum 1 are improved, and therefore, the image quality of the image formed by the image forming apparatus can be improved. Furthermore, the positioning accuracy of the cleaning blade 60 provided in the cleaning frame 51 relative to the photosensitive drum 1 can be improved. Therefore, the removal property in the removal of the residual toner from the photosensitive drum 1 can be improved.

In this embodiment, as described hereinbefore, the cartridge positioning portion 51*a* is included in the engagement range Z with respect to the direction perpendicular to the longitudinal direction of the cartridge 7. However, only a part of the positioning portion 51*a* may overlap the engagement width Z. On the contrary, the width of the positioning portion 51*a* may be larger than the engagement width Z.

In the case that the driving input gear 76 is a helical gear, the force Y is inclined corresponding to the angle of twist of the gear teeth. However, when the cleaning frame 51 is deformed by the moment about the positioning portion 51*a*, it will suffice if the component in a direction perpendicular to the supporting portion 72 (reference surface HP) is considered. That is, it is sufficient that the component in the direction of the force Y shown FIG. 10 is considered.

The positioning portion 51*a* is disposed above the driving input gear 76 when the cartridge 7 is set in place in the main assembly 100 of the apparatus. With this structure, the driving gear 70 and the second supporting portion 72 can be at different positions in the main assembly 100 of the apparatus, the main assembly 100 of the apparatus can be downsized, and the cartridge 7 can be downsized.

Moreover, the positioning portion 51*a* is provided by the peripheral surface of a cylindrical projection which is coaxial with the supporting hole supporting the pin 49. The projected portion is projected from the cleaning frame 51. The pin 49 is supported inside the projected portion. With this feature, the main assembly 100 of the apparatus can be downsized, and the cartridge 7 can be downsized.

The second cartridge positioning portion 51*a* may be provided only at one end side of the cartridge 7 with respect to the longitudinal direction. With the above-described positional relation between the engagement range Z and the cartridge positioning portion 51*a*, the deformation of the cleaning frame 51 can be suppressed, and the cartridge 7 can be correctly positioned to the main assembly 100 of the apparatus, even if the cartridge positioning portion is not provided at the other longitudinal end. This eliminates the necessity of a space for providing the positioning structure at the other side, so that the main assembly 100 of the apparatus and the cartridge 7 can be downsized. This advantage is significant particularly when the cartridges 7 are arranged substantially in the vertical direction in the main assembly of the multi-color image forming apparatus 100 as in this embodiment.

(Positional Relation Between Second Positioning Portion and Connection Pin)

FIGS. 11 and 15(*a*) show the relation between the positioning portion 51*a* and the connection pin 47. FIG. 11 is a view as in direction V3 in FIG. 10 (the direction of the axis of the developing roller 40).

At the engaging portion K between the driving input gear 76 and the driving gear 70, the driving input gear 76 receives an upper part force Y when the cartridge 7 is set in the main assembly 100 of the image forming apparatus. The driving input gear 76 is provided in the frame 45, and the force Y is transmitted to the frame 51 through the connection pin 47. The frame 51 is urged to the second cartridge positioning portion 51*a*. Here, the force received by the second cartridge positioning portion 51*a* is perpendicular to the reference surface HP. The connection pin 47 is provided at a position crossing the phantom line EL2. The phantom line EL2, as shown in FIG. 15, is perpendicular to the main assembly positioning portion 72 (reference surface HP) abutted to the positioning portion 51*a*.

With this structure, as seen in the direction V2, the force Y received from the driving gear 76 does not produce a moment to the cleaning frame 51 about the positioning portion 72. Therefore, deformation of the cleaning frame 51 is suppressed when the cartridge 7 is positioned relative to the main assembly 100 of the apparatus. Even when the rotational driving force is transmitted from the main assembly 100 of the apparatus to the driving input gear 76, deformation of the developing device frame 45 rotatably supported on the cleaning frame 51 can be suppressed. Therefore, the positional accuracy of the developing roller 40 and the toner supplying roller 43 relative to the photosensitive drum 1 can be improved. In addition, the positional accuracy of the cleaning blade 60 provided in the cleaning frame 51, relative to the photosensitive drum 1 can be improved. The removal property of the residual toner from the photosensitive drum 1 can be improved.

(Checking Method)

Figure 12:
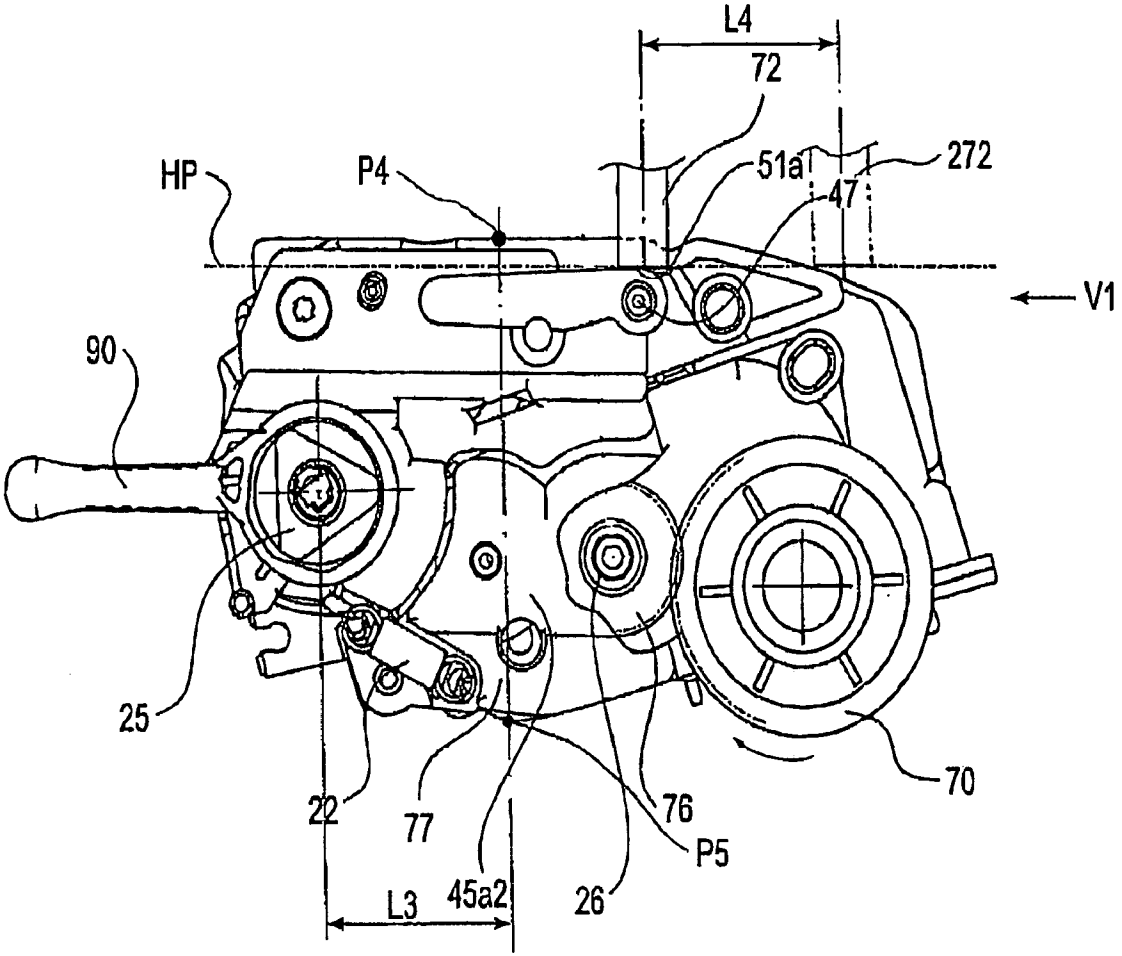
FIG. 12 is a sectional view of a process cartridge according to an embodiment of the present

FIG. 12 illustrates a checking method for the deformation of the cartridge 7. For example, the amount of deformation of the cleaning frame 51 (a displacement from the reference surface HP at point P4) or the amount of deformation of the developing device frame (a displacement from the reference surface HP at point P5) is measured at a position a predetermined distance L3 away from the center of the coupling 25 (reference). For example, the deformation amount is compared with that when the supporting portion 272 is a distance L4 away from the supporting portion 72. By doing so, the effect of the embodiment can be confirmed. The measurements may be carried out using a dial gauge.

(Positional Relation Between Second Positioning Portion and Connection Pin in Longitudinal Direction).

As shown in FIG. 10, the positioning portion 51*a* is located at a position overlapping with the hole 52*a* engaged with the connection pin 47, as seen in the direction perpendicular to the longitudinal direction of the cartridge 7. When the engagement hole 52*a* is seen in the direction which is perpendicular to the longitudinal direction and which passes through the positioning portion 51*a*, the engagement hole 52*a* and the positioning portion 51*a* overlap with each other. With this structure, the cartridge 7 is free of or subjected to less moment about the positioning portion 51*a* as seen in the direction V1. This is because, similarly to the description with respect to the V3, the force Y acts on the main assembly positioning portion 72 through the connection pin 47. Therefore, the deformation of the cleaning frame 51 is suppressed, when the cartridge 7 is positioned to the main assembly 100 of the apparatus. Thus, even when the rotational driving force is transmitted to the driving input gear 76 from the main assembly 100 of the apparatus, the positioning accuracy of the cleaning blade 60 relative to the photosensitive drum 1 can be improved. The removal property of the residual toner from the photosensitive drum 1 can be improved. In addition, the deformation of the developing device frame 45 rotatable supported on the cleaning frame 51 can be suppressed. Therefore, the positional accuracy of the developing roller 40 and the toner supplying roller 43 relative to the photosensitive drum 1 can be improved.

Figure 13:
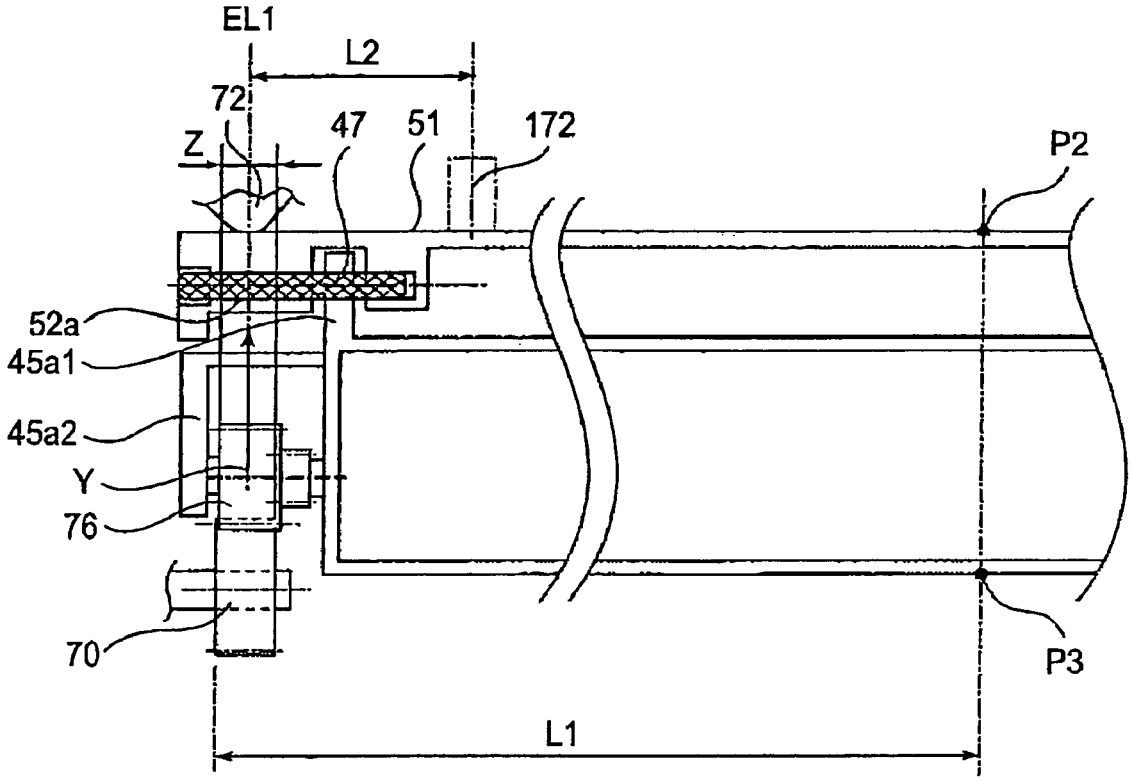
FIG. 13 is a sectional view of a process cartridge according to an embodiment of the present invention.

FIG. 13 illustrates a checking method for the deformation of the cartridge 7 with respect to the longitudinal direction. For example, a deformation amount of the cleaning frame at a position a predetermined distance L1 away from an end of the driving gear 70 (reference point), which is a displacement from a reference surface HP at the point P2, or a deformation amount of the developing device frame (a displacement from the reference plane HP at point P3), are measured. More particularly, the deformations are compared with deformations which are measured when the supporting portion 172 is at a position L2 away from the point EL1. By doing so, the effect of the embodiment can be confirmed. The measurements may be carried out using a dial gauge.

In the first and second embodiments, the material of the cleaning frame 51 and the developing device frame 45 is a styrene material, such as high impact polystyrene (HIPS), acrylic nytril butadiene polymer (ABS) or the like. From the standpoint of moldability and the cost, the thicknesses of the cleaning frame 51 and the developing device frame 45 are small. However, in order to assure the mechanical strength of the frame, a certain degree of thickness (approximately 2 mm) is required even when such a material is used. According to the present invention, the thickness can be reduced (for example, to the degree of 1.5 mm). In some cases, in order to reinforce the frame, a metal plate has been used at an upper part of the cartridge. However, according to the present invention, there is no need to use such a metal plate. This accomplishes cost reduction, downsizing, lightening, and better assembling properties. As described in the foregoing, according to the present invention, the deformation of the process cartridge is suppressed when the rotational driving force is transmitted from the main assembly of the electrophotographic image forming apparatus. With respect to the positioning of a process cartridge having the first frame and the frame rotatably connected with the frame relative to the electrophotographic image forming apparatus, the deformation of the frame can be suppressed when the driving force is transmitted from the main assembly of the apparatus. The positional accuracy of the developing roller is improved when the rotational driving force is transmitted from the main assembly of the electrophotographic image forming apparatus in the developing cartridge, the process cartridge and the electrophotographic image forming apparatus. In addition, the developing cartridge, the process cartridge and the electrophotographic image forming apparatus can be downsized.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 293847/2004 filed Oct. 6, 2004, which is hereby incorporated by reference.

What is claimed is:

1. A process cartridge detachably mountable to an electrophotographic image forming apparatus, said process cartridge comprising:

an electrophotographic photosensitive drum;

a developing roller configured and positioned to develop an electrostatic latent image formed on said electrophotographic photosensitive drum;

a first frame supporting said electrophotographic photosensitive drum;

a second frame supporting said developing roller;

a coupling member configured and positioned to rotatably couple said first frame and said second frame;

a first cartridge positioning portion which is provided at each of one and the other longitudinal end portions of said process cartridge and which is abuttable to a first main assembly positioning portion provided in a main assembly of the apparatus to position said process cartridge with respect to a direction crossing a direction of an axis of said electrophotographic photosensitive drum, when said process cartridge is mounted to the main assembly of the apparatus;

a drive input gear, provided at one of the longitudinal ends of said second frame, configured and positioned to engage a main assembly driving gear provided in the main assembly to receive a rotational driving force for rotating said developing roller;

a second cartridge positioning portion which is provided at one longitudinal end portion of said process cartridge and which is abuttable to a second main assembly positioning portion provided in the main assembly of the apparatus to limit rotation of said process cartridge about said first cartridge positioning portion, when said driving input gear receives the rotational driving force from the main assembly driving gear, wherein in a state in which said process cartridge is set in the main assembly of the apparatus, said coupling member is located at a position crossing a phantom line which is perpendicular to the second main assembly positioning portion abutting second cartridge positioning portion and which passes through said second cartridge positioning portion, as seen from one end of said cartridge with respect to the axis.

2. A process cartridge according to claim 1, wherein said coupling member is in the form of a pin having a circular section and extends parallel to the axis.

3. A process cartridge according to claim 1, wherein said second cartridge positioning portion is a peripheral surface of a cylindrical projection.

4. A process cartridge according to claim 3, wherein an inside of said cylindrical projection supports said coupling member.

5. A process cartridge according to claim 1, wherein said second cartridge positioning portion is disposed above said driving input gear in a state in which said process cartridge is set in the main assembly of the apparatus, and said driving input gear is disposed below said coupling member.

6. A process cartridge according to claim 1, further comprising a cleaning blade, provided in said first frame, configured and positioned to remove the developer from a peripheral surface of said electrophotographic photosensitive drum.

7. A process cartridge according to claim 1, wherein said coupling member is an engaging hole in said first frame, said engaging hole being at a position at least partly overlying a part of said second cartridge positioning portion, as seen in the direction which is perpendicular to the longitudinal direction of said process cartridge and which passes through said second cartridge positioning portion.

8. An electrophotographic image forming apparatus for forming an image on a recording material, to which a process cartridge is detachably mountable, said apparatus comprising:

(a) a first main assembly positioning portion provided in a main assembly of said apparatus;

(b) a second main assembly positioning portion provided in the main assembly of said apparatus;

(c) a main assembly driving gear provided in the main assembly of said apparatus;

(d) mounting means for detachably mounting a process cartridge, said process cartridge including an electrophotographic photosensitive drum, a developing roller configured and positioned to develop an electrostatic latent image formed on the electrophotographic photosensitive drum, a first frame supporting the electrophotographic photosensitive drum, a second frame supporting the developing roller, a coupling member configured and positioned to rotatably couple the first frame and the second frame, a first cartridge positioning portion which is provided at each of one and the other longitudinal end portions of the first frame and which is abuttable to said first main assembly positioning portion to position the process cartridge with respect to a direction crossing a direction of an axis of the electrophotographic photosensitive drum, when the process cartridge is mounted to the main assembly of said apparatus, a driving input gear, provided at one of the longitudinal end ends of said second frame, configured and positioned to engage said main assembly driving gear to receive a rotational driving force for rotating the developing roller, a second cartridge positioning portion which is provided at one longitudinal end portion of the process cartridge and which is abuttable to said second main assembly positioning portion provided to limit rotation of the process cartridge about said first cartridge positioning portion, when the driving input gear receives the rotational driving force from said main assembly driving gear, wherein in a state in which the process cartridge is set in the main assembly of said apparatus, the coupling member is located at a position crossing a phantom line which is perpendicular to said second main assembly positioning portion abutting the second cartridge positioning portion and which passes through the second cartridge positioning portion, as seen from one end of the cartridge with respect to the axis; and (e) feeding means for feeding the recording material.

* * * * *

UNITED STATES PATENT AND TRADEMARK OFFICE

CERTIFICATE OF CORRECTION

PATENT NO. : 7,158,736 B2
APPLICATION NO. : 10/960077
DATED : January 2, 2007
INVENTOR(S) : Masaaki Sato et al.

It is certified that error appears in the above-identified patent and that said Letters Patent is hereby corrected as shown below:

COLUMN 1:
Line 29, "Such is" should read --Such a--.

COLUMN 12:
Line 42, "rotatable" should read --rotatably--.

COLUMN 14:
Line 63, "end" should be deleted.

Signed and Sealed this

Twenty-ninth Day of July, 2008

JON W. DUDAS
*Director of the United States Patent and Trademark Office*